United States Patent [19]

Leonard

[11] Patent Number: 4,616,483

[45] Date of Patent: Oct. 14, 1986

[54] DIFFUSER WALL CONTROL

[75] Inventor: Gary S. Leonard, Minoa, N.Y.

[73] Assignee: Carrier Corporation, Syracuse, N.Y.

[21] Appl. No.: 730,411

[22] Filed: Apr. 29, 1985

[51] Int. Cl.[4] ..... F25B 1/04; F25B 49/00; F04B 29/46

[52] U.S. Cl. ..... 62/115; 62/228.5; 415/47; 417/280; 417/282

[58] Field of Search ..... 417/280, 293, 282, 423 R; 415/30, 46, 148, 47, 36; 62/115, 228.5

[56] References Cited

U.S. PATENT DOCUMENTS

| | | | |
|---|---|---|---|
| 4,503,684 | 3/1985 | Mount et al. | 62/115 |
| 4,527,949 | 7/1985 | Kirtland | 415/150 |
| 4,544,325 | 10/1985 | Rogo et al. | 415/46 X |

*Primary Examiner*—Carlton R. Croyle
*Assistant Examiner*—Theodore W. Olds
*Attorney, Agent, or Firm*—Thomas J. Wall

[57] ABSTRACT

In a motor driven centrifugal compressor having a diffuser containing a movable wall for varying the width of the diffuser passage, control equipment is provided for continually changing the wall position in response to changes in motor current.

5 Claims, 7 Drawing Figures

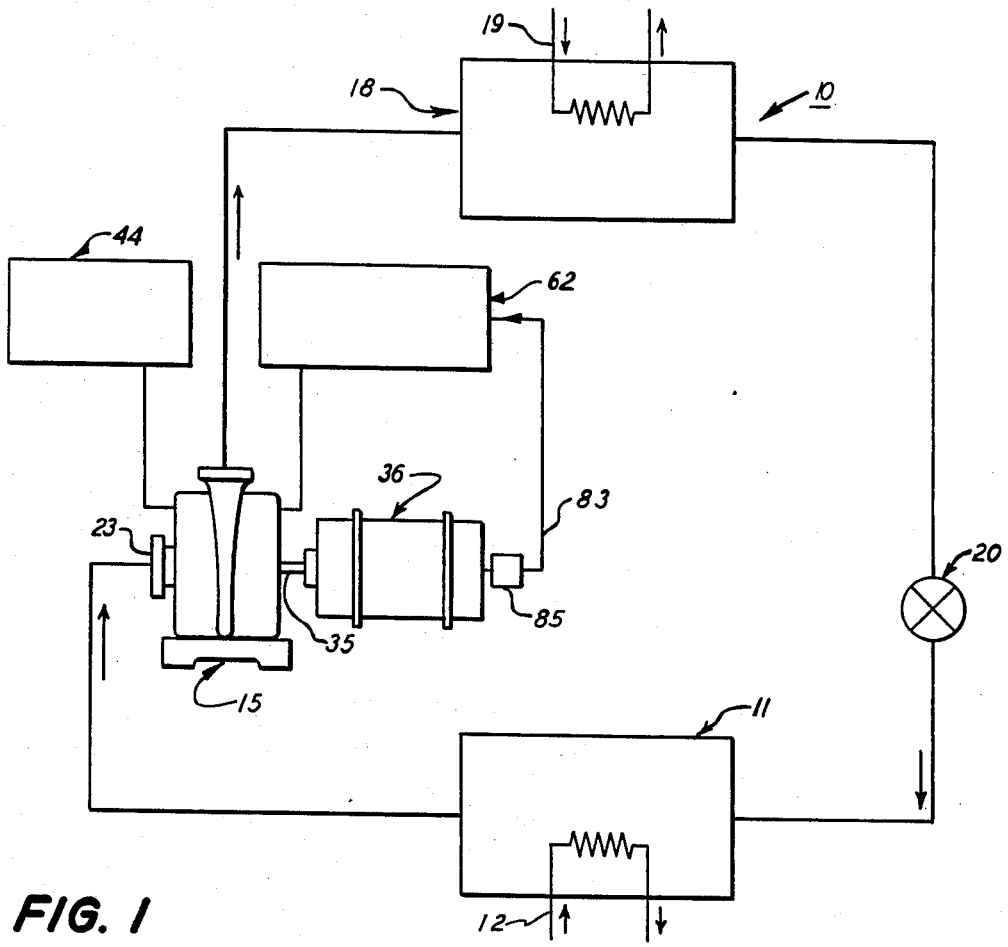
FIG. 1
FIG. 3
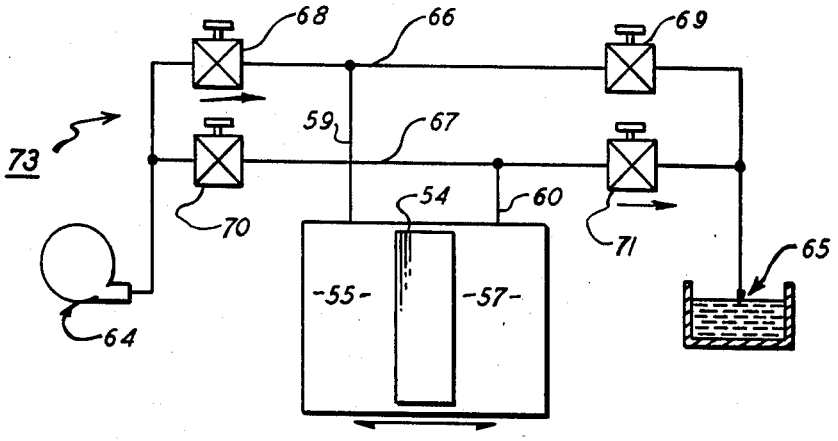

DIFFUSER WALL CONTROL

BACKGROUND OF THE INVENTION

This invention relates to a refrigeration system employing a motor driven centrifugal compressor having a diffuser with a movable wall and, in particular, to controlling the positioning of the movable wall to continually maintain the compressor at or about optimum operating conditions as the load thereon changes.

Variable speed centrifugal compressors have been used in the art to control the amount of refrigerant flowing through heating and cooling systems using the carnot cycle. These variable speed machines, although working quite well in practice, are relatively expensive to build and oftentimes difficult to maintain. Accordingly, these machines have not found wide spread use in the industry. Most centrifugal compressors that are presently in use are arranged to turn at a fixed operational speed and control over the machinery is achieved by adjusting the positioning of guide vanes located at the entrance to the impeller wheel.

In a refrigeration system utilizing a fixed speed centrifugal compressor, the mass rate of flow delivered to the compressor impeller is typically varied to meet the changing demands placed on this system. Under maximum flow conditions, the amount of refrigerant leaving the impeller blades is sometimes more than the diffuser section can handle and the flow thus becomes choked at the diffuser entrance or throat. At relatively low flow rates, the refrigerant flow moving through the diffuser section becomes unstable and a partial reversal in the flow pattern takes place. This, in turn, produces a good deal of noise and a dramatic reduction in machine efficiency. Ultimately, a complete reversal in the flow pattern is experienced whereupon the compressor will stall or surge. The flow rate spread between a choked condition and a surge condition generally defines the operating range of the machine. In a fixed speed compressor, wherein the inlet guide vanes are used to maintain flow control, this operating range is typically very narrow.

In a copending U.S. patent application Ser. No. 531,019, filed Sept. 12, 1983 in the name of Kirtland, there is described a centrifugal compressor having a diffuser in which one wall is movably mounted so that the width of the diffuser opening can be varied to meet different load conditions placed on the system. In a later filed U.S. Pat. No. 4,503,684, which issued to Mount et al, there is described a control system for use in conjunction with a variable width diffuser for monitoring the lift and the load placed on the compressor and adjusting the movable wall position to hold the machine at or close to optimum operating conditions. The load is determined by measuring the current flow through the compressor motor while the lift is determined by comparing the temperatures of the water leaving the evaporator and the condenser of the refrigeration system.

The Mount et al control system works exceedingly well in practice but requires the use of a minicomputer to track both load and lift. The present invention recognizes the many advantages of the Mount et al control system and provides a method by which the diffuser width can be varied using less equipment thereby reducing the cost of the refrigeration system without significantly sacrificing operating efficiency.

SUMMARY OF THE INVENTION

It is therefore an object of the present invention to improve refrigeration systems.

It is a further object of the present invention to simplify the controls used to vary the diffuser width in a centrifugal compressor used in a refrigeration system.

A still further object of the present invention is to reduce the equipment costs in a centrifugal compressor which utilizes a variable width diffuser.

Another object of the present invention is to reduce the amount of equipment needed to control the positioning of a diffuser wall in a compressor utilizing a variable width diffuser.

These and other objects of the present invention are attained in a refrigeration system that utilizes a motor driven centrifugal compressor having a moveable wall positioned in the diffuser that permits the width of the diffuser passage to be varied to meet changing load conditions within a desired operating range. The percent of full load current drawn by the compressor motor is continually monitored and provides an indication of the percent of full load capacity at which the compressor is operating. A desired condenser water schedule curve that relates motor current to the width of the diffuser opening is derived by plotting optimum lift to optimum load for the desired temperature range. The diffuser wall position is changed in response to changes in measured compressor motor current to hold the wall at an optimum operating position for the measured load.

BRIEF DESCRIPTION OF THE DRAWINGS

For a better understanding of these and other objects of the present invention reference is had to the following detailed description of the invention which is to be read in conjunction with the accompanying drawings, wherein:

FIG. 1 is a schematic diagram showing a refrigeration system embodying the teachings of the present invention;

FIG. 3 is a schematic diagram showing a valve actuated control unit employed in the present invention for repositioning the diffuser wall and thus changing the width of the diffuser opening;

DESCRIPTION OF THE INVENTION

Figure 2:
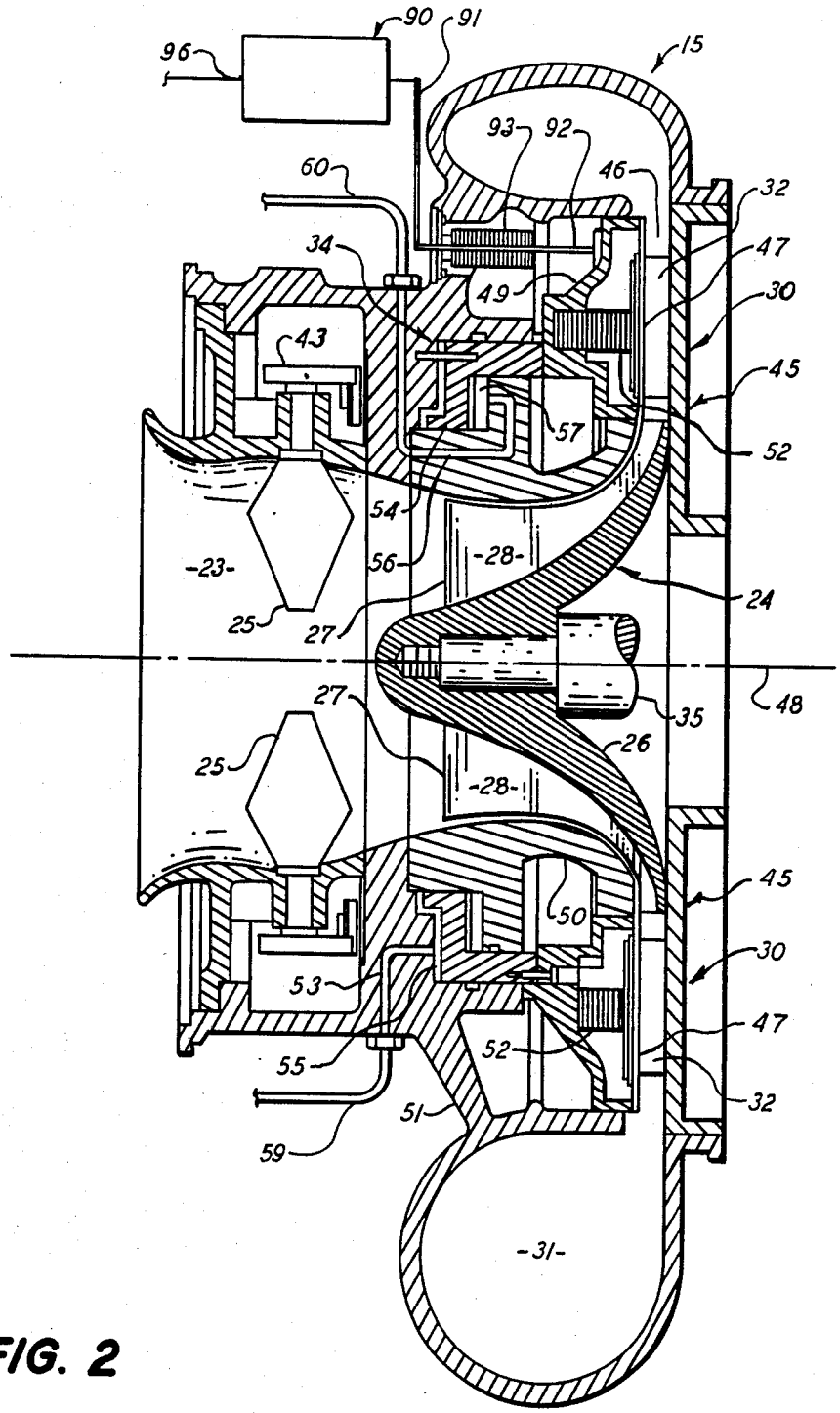
FIG. 2 is a sectional side elevation taken through the motor driven centrifugal compressor shown in the refrigeration system of FIG. 1.

Turning now to the drawings, and specifically to FIG. 1, there is shown a refrigeration system generally referenced 10 which is used to chill water or the like within an evaporator heat exchanger (water chiller) 11.

The water to be chilled is circulated through the evaporator unit by means of a flow circuit 12 whereby energy (heat) is drawn from the water and absorbed by refrigerant thereby cooling the water. The heated refrigerant is caused to evaporate or partially evaporate in heat exchanger 11 and the refrigerant drawn from the chiller unit by means of a motor driven centrifugal compressor, generally depicted at 15. In operation, the compressor serves to pump refrigerant to a higher temperature and pressure thereby slightly superheating the refrigerant vapors. The refrigerant leaving the compressor is passed through a condenser heat exchanger 18 where the superheat and latent heat of vaporization is removed by transferring the energy to cooling water that is passed through the unit by means of a flow circuit 19. Refrigerant leaving the condenser is flashed or throttled to a lower temperature by means of an expansion valve 20 before being once more delivered to the inlet of chiller 11 unit thereby completing the refrigeration loop.

Compressor 15 utilized in the present refrigeration system is a single stage machine design to operate at a constant speed. However, it should be obvious to one skilled in the art that a multiple stage compressor may be similarly utilized within the system without departing from the teachings of the present invention. As disclosed in the noted co-pending Kirtland application, the compressor as shown in FIG. 2, includes an axially aligned inlet 23 that directs incoming refrigerant into the blades 27—27 of a rotating impeller wheel 24 through a series of adjustable inlet guide vanes 25-25. The impeller wheel includes a central hub 26 which supports the blades so that they form passages 28—28 for directing refrigerant through the rotating assembly. Refrigerant moving through the blade passages is turned radially and is discharged into a diffuser section generally referenced 30. The diffuser assembly surrounds the impeller wheel and serves to bring the refrigerant leaving the impeller blade tips into a toroidal-shaped volute or collector 31. Under the combined action of both the diffuser and the collector, kinetic energy stored within the refrigerant is converted into static pressure as the refrigerant expands under controlled conditions. The hub 26 of the impeller wheel is coupled to an electrical drive motor 36 (FIG. 1) by means of a drive shaft 35. The drive motor is arranged to turn the impeller at a constant operational speed.

The flow of refrigerant through the machine is regulated by adjustably positioning the inlet guide vanes in a manner well known and used in the art. The position of the vanes is selectively adjusted by use of a cable and pulley mechanism depicted at 43 which is arranged to change the position of each blade simultaneously in response to a control signal from a flow control unit 44 (FIG. 1). The diffuser section of the compressor contains a radially disposed stationary wall 45 that forms the back of the diffuser passage 46. A movable wall 47 is located on the opposite or front side of the passage. The movable wall is radially extended in regard to the center line 48 of the impeller wheel and is arranged to move axially towards and away from the fixed wall so as to alter the width of the diffuser passage. By varying the width of the diffuser passage, the flow of refrigerant passing through this critical section can be closely controlled to avoid surging at reduced flow rates and thus improve the operating efficiency over a relatively wide operating range of the machine. As will be explained in greater detail below, by continually monitoring the current flow through the compressor motor, it is possible to maintain the machine at an optimum operating point close to or near the surge line without encountering stall.

The movable front wall of the diffuser section is secured to a generally annular carriage 49 that is slidably contained within the compressor between shroud 50 and the main machine casing 51. The movable wall is secured to the carriage by any suitable means so that the two members will move in concert towards and away from fixed wall 45 of the diffuser section. A series of diffuser vanes 32—32 pass through the movable wall into the diffuser passage and are held in biasing contact against the fixed wall by means of springs 52—52. The carriage, as illustrated in FIG. 2, is shown retracted against the machine casing thus bringing the diffuser passage to a fully opened condition.

Carriage 49 is, in turn, secured to a double acting piston by threaded connectors or the like. The piston is reciprocally mounted in a cylinder 34 formed between the shroud and the machine casing so that it is able to be driven axially in either direction. A first flow channel 53 is arranged to bring hydraulic fluid into and out of the front chamber 55 of the cylinder. A second flow channel 56 is similarly arranged to carry fluid into and out of the rear chamber 57 of the cylinder. A pair of control lines 59 and 60 connect the two flow passages with a control unit 62 (FIG. 1). Hydraulic fluid is selectively exchanged between the control unit and the two chambers of the piston containing cylinder to drive the piston, and thus the movable diffuser wall, in a desired direction.

The control unit 62 is shown in greater detail in FIG. 3 and includes a pump 64 and a hydraulic sump 65 which are connected by means of two flow lines 66 and 67. Flow line 66 contains a pair of solenoid actuated valves 68 and 69 while flow line 67 contains a similar pair of solenoid actuated valves 70 and 71. By electrically controlling the positioning of the valves, hydraulic fluid can be selectively routed into the piston cylinder to move the wall to a desired position. To initiate travel of the piston in either direction requires energization (opening) of one pair of the four solenoid actuated valves. For example, as illustrated in FIG. 3 by the arrows, energization of valve pair 68 and 71 will cause hydraulic fluid to be fed via line 59 into the front chamber of the piston cylinder while, at the same time, fluid is drawn from the rear chamber of the cylinder and exhausts it to the sump 65 via line 60. As can be seen, this selective energization of the valves causes the piston to move in a wall closing direction. Energization of the opposing pair of valves 69 and 70 will cause the hydraulic fluid flow pattern to be reversed and the wall will thus be moved back towards a more fully opened position.

In many water chiller applications, the temperature of the water leaving the chiller (evaporator) remains relatively constant, however, the condenser water temperature will vary in response to changes in load and outdoor air temperature conditions. Accordingly, any drop in the condenser water temperature will reflect a corresponding drop in the compressor load. A compressor map, such as that shown in FIG. 6, can be developed for a given system in which changes in load are plotted against lift. Lift can be expressed in terms of entering condenser water temperature while load can be expressed in terms of the amount of current drawn by the compressor motor. Curve 40 represents the envelope or boundaries of the system on the map while curve 41 represents a typical load line within the envelope for a condenser having an operating range between 60 F. and 85 F. Using American Refrigeration Institute (ARI) standard for rating and testing refrigeration systems, any number of load lines similar to line 41 can be generated for describing a desired lift in terms of load for the most efficient operation of the system. As is typical, this relationship is relatively linear whereby the load drops uniformly for every degree of condenser water temperature that is lost.

The optimum lift (head) for the compressor thus has a specific relationship to the load placed on the compressor. Since the optimum or desired diffuser width is also a function of lift and load, it is possible to express passage width in terms of one of these two-ply parameters. In the present invention, load in terms of the current drawn by the compressor motor is used to determine the desired width of the diffuser passage to hold the machine at, or close to, optimum operating efficiency as the load demands on the system change.

Figure 4:
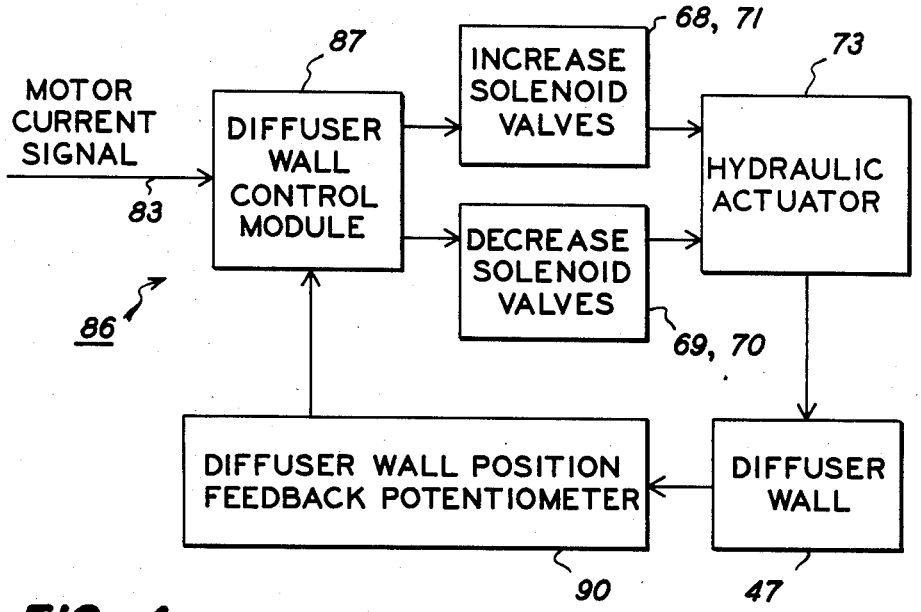
FIG. 4 is a flow diagram showing the method of positioning the movable diffuser wall utilized in the practice of the present invention.

FIG. 4 is a block diagram showing a wall positioning unit, generally referenced 86, for positioning the movable diffuser wall in response to changes in the compressor motor current flow to provide for efficient operation of the compressor over a wide operating range. The wall positioning unit forms part of the overall control unit 62. For purposes of explanation, it will be assumed that the condenser follows the load line shown in FIG. 6. A current sensor 85 is connected over the compressor motor 36 as seen in FIG. 1. The sensor monitors the motor current and provides an output signal indicative of motor current via line 83 to the diffuser wall control module 87. A second input signal is also furnished to the control module by a linear feedback potentiometer 90.

The feedback potentiometer is arranged to sense the position of the movable diffuser wall and provide an output signal indicative of the sensed position. The potentiometer assembly includes a sensing rod 92 that is coupled to a bellows 93 and adapted to ride in biasing contact against the movable wall carriage 49 (FIG. 2). The rod is connected to the potentiometer input by an arm 91 whereby the output signal changes linearly in response to changes in the wall position.

Figure 7:
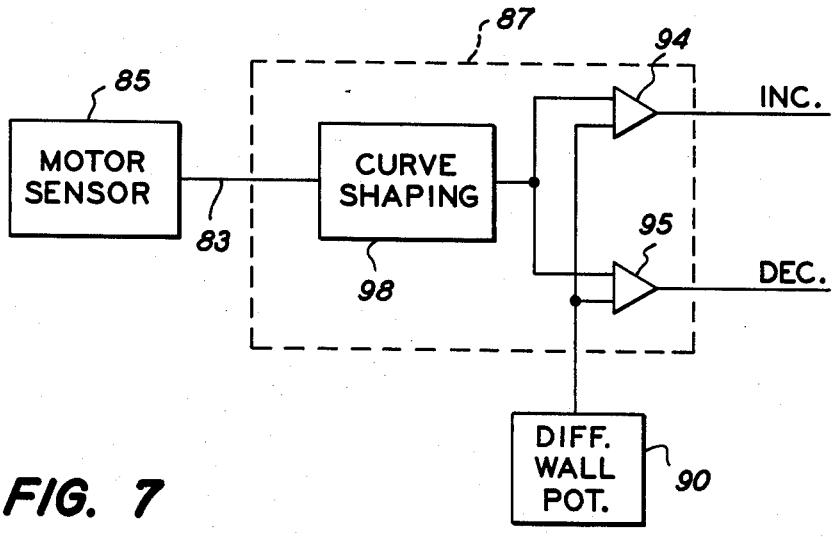
FIG. 7 is an electrical diagram showing circuitry used in the repositioning of the diffuser wall in response to changes in sensed motor current.

The diffuser wall control module includes a pulse shaping circuit 98 and a pair of comparator units 94 and 95 as shown in FIG. 7. The output signal applied to the module from the motor current sensor is initially passed through the shaping circuit and is applied to one of the input terminals of the two comparators. The shaping circuitry is arranged to adjust the gain of the current sensing signal at various breakpoints so that the output signal applied to the comparators follows a relatively smooth curve. The output signal of the wall potentiometer is applied to the second input of the two comparators. As can be seen, the comparators are thus both provided with a first input signal indicative of the desired optimum wall position based on motor load and a second input signal indicative of the actual wall position.

Figure 5:
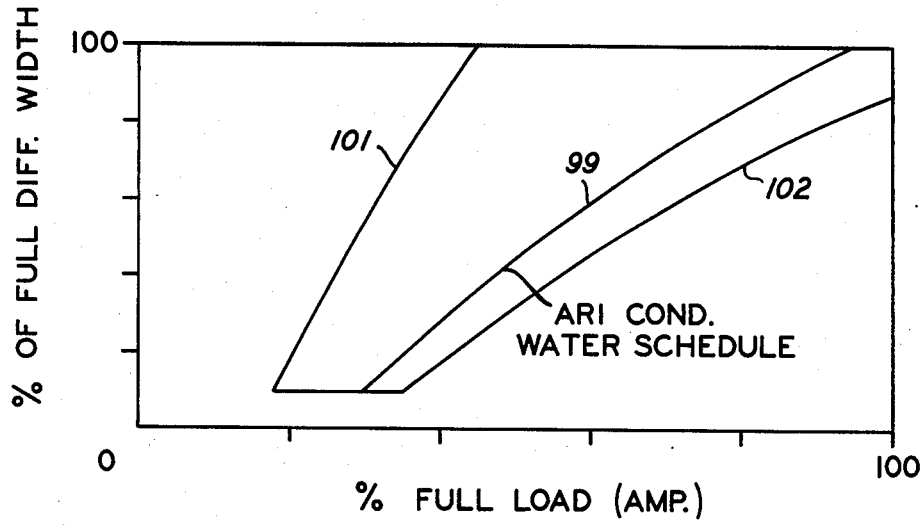
FIG. 5 is a graphic representation showing a condenser water-load schedule in which the percent wall for optimum operation opening is plotted against the measured compressor motor current.
Figure 6:
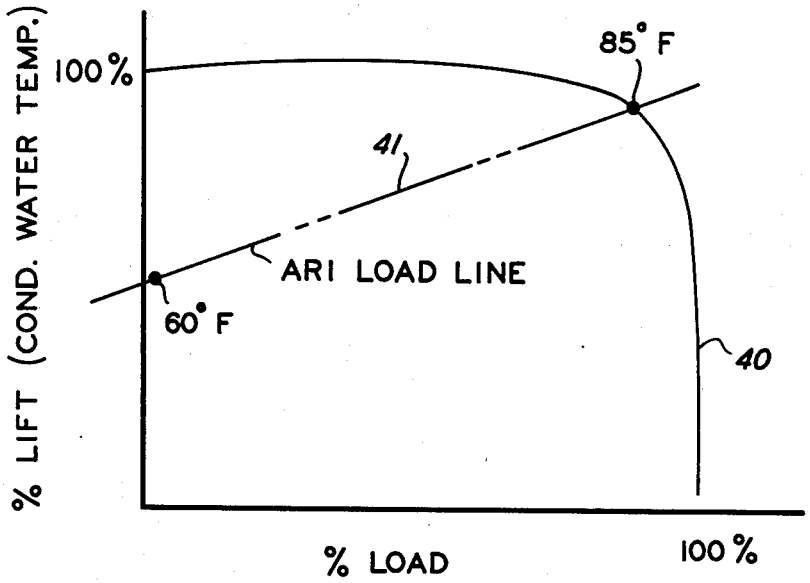
FIG. 6 is a compressor map for the present centrifugal machine wherein optimum lift is plotted against optimum load within a specific condenser water temperature.

As shown in FIG. 5, condenser water schedule curves may be generated from the previously noted ARI operating characteristic curves described in reference to FIG. 6. The curve depicted at 101 describes a typical schedule at the low lift design point while the curve depicted at 102 describes a typical schedule at high lift design point. Schedule curve 99 has been developed from the ARI load line 41 shown on the compressor map and relates the motor load to the optimum wall position for operating points along the load line. The comparator units, through this known relationship, are thus able to compare the actual wall position to the desired wall position. Comparator 94 is adapted to send an actuating signal to solenoid actuated valves 68, 71 in the event the diffuser passage width must be increased to meet changing load demands. The comparator is arranged to only provide an output signal if the load demands are increasing and will not output if the load demands are decreasing. Similarly comparator 95 will send an activating signal to solenoid actuated valves 69 and 70 in the event the width of diffuser passage must be decreased. Here again the comparator is arranged to only provide an output signal when the load demands are decreasing.

As should now be evident, the comparators are adapted to compare the actual wall position related signal with the desired wall position related signal and instruct the solenoid actuated valves to take appropriate corrective action necessary to bring the wall to a desired optimum operating position. As can be seen, by relating the centrifugal compressor motor current to an optimum condenser water schedule as herein explained, the proper diffuser wall setting can be rapidly and accurately implemented without the need of extensive hardware and complex control equipment. The present method of controlling the positioning of the diffuser wall is thus relatively inexpensive but yet effective in holding the compressor within a desired operating range.

While this invention has been described with specific reference to the structure disclosed herein, it is not necessarily confined to the details as set forth and this application is intended to cover all modifications and changes that may come within the scope of the following claims.

I claim:

1. A method of controlling a motor driven centrifugal compressor used in a refrigeration system that includes movably mounting at least one wall in a compressor diffuser so that the size of the diffuser opening may be varied, developing a theoretical condenser water schedule curve for optimum operation of the compressor, relating the water schedule curve to the motor current and the wall position so that desired wall positions can be determined from motor current values, measuring the motor current and determining a desired wall position, sensing the actual position of the movable wall, comparing the actual position of said wall to the desired position of said wall, moving said wall to the desired position in the event the actual position is different than the desired position.

2. The method of claim 1 that further includes the steps of generating a first output signal indicative of the optimum wall position for the measured current load, generating a second output signal indicative of the actual wall position that is sensed, and comparing the two output signals to determine the difference between the actual wall position and the optimum wall position.

3. The method of claim 2 that further includes mounting the movable wall upon a fluid activated carriage so that the wall moves towards and away from a fixed diffuser wall and controlling the positioning of the wall by electrically actuated valves.

4. The method of claim 3 that further includes the step generating a control signal indicative of the difference between the actual wall position and the optimum wall position and applying the control signal to said electrically actuated valves to move the wall to an optimum position.

5. The method of claim 4 that includes the further step of attaching the carriage to a double acting piston and controlling the flow of fluid to each side of the piston to move the wall to a desired position.

* * * * *